US008662001B1

(12) United States Patent
Hebert

(10) Patent No.: US 8,662,001 B1
(45) Date of Patent: Mar. 4, 2014

(54) FOLD-UP GRAPPLING DEVICE

(76) Inventor: Jacques Hebert, Jeanerette, LA (US)

( * ) Notice: Subject to any disclaimer, the term of this patent is extended or adjusted under 35 U.S.C. 154(b) by 446 days.

(21) Appl. No.: 13/031,144

(22) Filed: Feb. 18, 2011

Related U.S. Application Data

(60) Provisional application No. 61/305,933, filed on Feb. 18, 2010.

(51) Int. Cl.
*B63B 21/38* (2006.01)

(52) U.S. Cl.
USPC ..... 114/304; 294/82.11

(58) Field of Classification Search
USPC ..... 114/294, 301–307; 294/115
See application file for complete search history.

(56) References Cited

U.S. PATENT DOCUMENTS 1,373,067 A * 3/1921 Goodreau ..... 114/305
1,495,544 A * 5/1924 Abernathy ..... 294/86.29
2,940,411 A * 6/1960 Bartels et al. ..... 114/299
3,123,037 A * 3/1964 Jensen ..... 114/298
3,197,169 A * 7/1965 Burrows ..... 248/690

* cited by examiner

*Primary Examiner* — Edwin Swinehart
(74) *Attorney, Agent, or Firm* — Raymond G. Areaux; Ian C. Barras; Carver, Darden, Koretzky, Tessier, Finn, Blossman & Areaux, LLC

(57) ABSTRACT

Exemplary embodiments provide a foldable grappling device comprising a shank or crown having a hollow tubular shaft member and a telescopic slide bar slidably coupled within the hollow tubular shaft member. The device further includes a plurality of foldable grappling arms attached to a base of the shank or crown and a plurality of linking arms coupled to the telescopic slide bar to push the grappling arms to an unfolded position from a folded position or pull the grappling arms to the folded position from the unfolded position. Raising the telescopic slide bar within the hollow tubular shaft member unfolds the foldable grappling arms simultaneously and when lowering the telescopic slide bar, the foldable grappling arms are folded simultaneously.

59 Claims, 8 Drawing Sheets

FOLD-UP GRAPPLING DEVICE

The present application claims priority from U.S. Provisional Application No. 61/305,933, filed Feb. 18, 2010, which is incorporated herein by reference as if set forth in full below.

BACKGROUND OF THE INVENTION

I. Field

The present invention relates to a fold-up grappling device that can be easily stowed more compactly.

II. Background

Anchors generally include a shank with armatures radiating therefrom. The arms of an anchor are generally fixed and take up space within the boat. As the anchor is used, the arms become dirty and coated with mud. Thus, when the anchor is placed back in the boat, the dirt can soil the boat.

Thus, there is a continuing need for a fold-up grappling device that can be folded and placed in a bucket or container for compact storage.

SUMMARY OF THE INVENTION

In view of the aforementioned problems, it is an object of the present invention to provide a fold-up grappling device as described herein.

Exemplary embodiments provide a fold-up grappling device comprising a shank or crown having a hollow tubular shaft member and a telescopic slide bar slidably coupled within the hollow tubular shaft member. The device further includes a plurality of foldable grappling arms attached to a base of the shank or crown and a plurality of linking arms coupled to the telescopic slide bar to push the grappling arms to an unfolded position from a folded position or pull the grappling arms to the folded position from the unfolded position. Raising the telescopic slide bar within the hollow tubular shaft member unfolds the foldable grappling arms simultaneously and when lowering the telescopic slide bar, the foldable grappling arms are folded simultaneously.

The above and other objects and features of the present invention will become apparent from the drawings, the description given herein, and the appended claims.

For a further understanding of the nature and objects of the present invention, reference should be had to the following description taken in conjunction with appended claims and with the accompanying drawings in which like parts are given like reference numerals.

Figure 1:
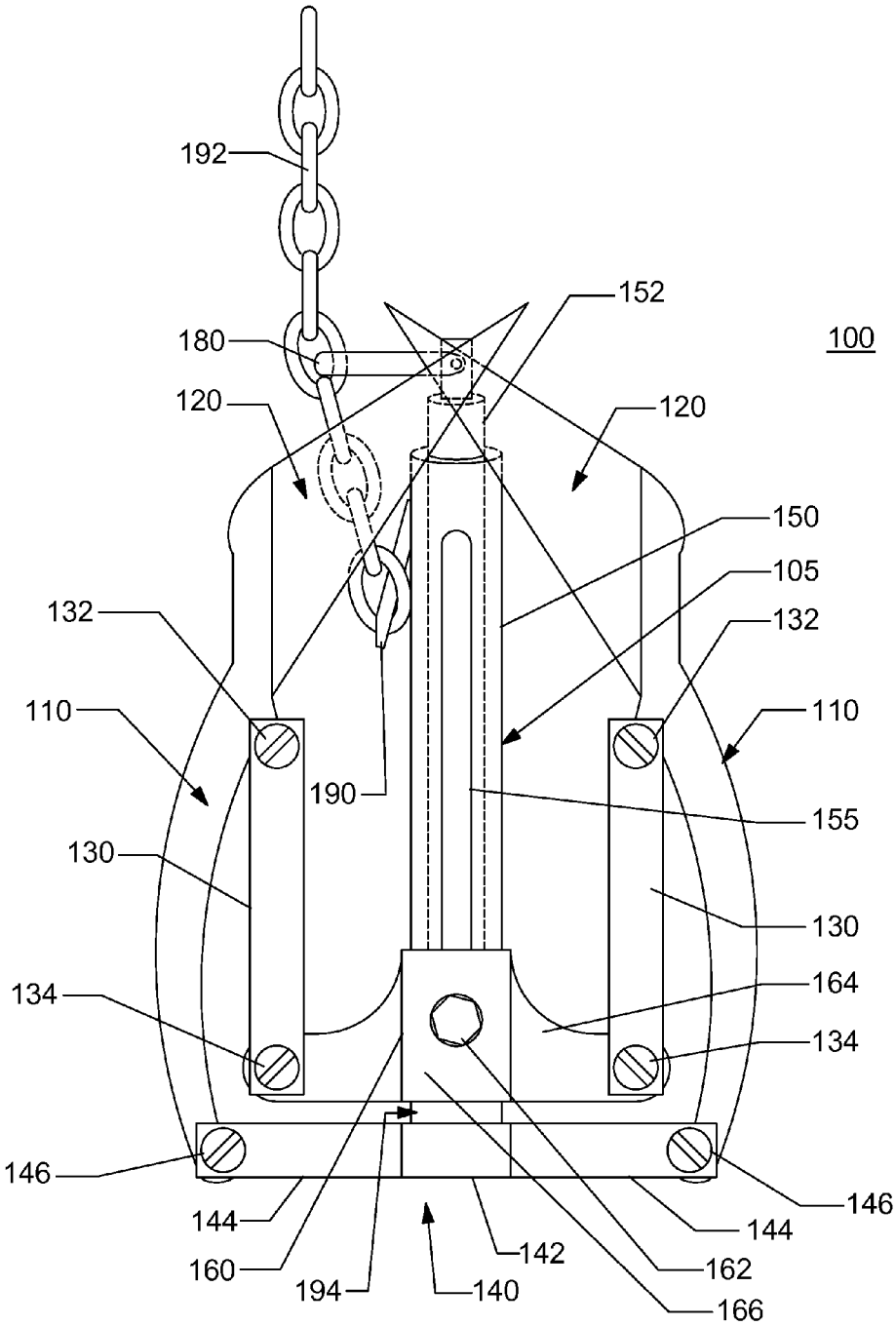
FIG. 1 illustrates a side view of a fold-up grappling device in a folded position in accordance with an exemplary embodiment of the present invention.

The images in the drawings are simplified for illustrative purposes and are not depicted to scale. Within the descriptions of the figures, similar elements are provided similar names and reference numerals as those of the previous figure (s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION OF THE INVENTION

Figure 2:
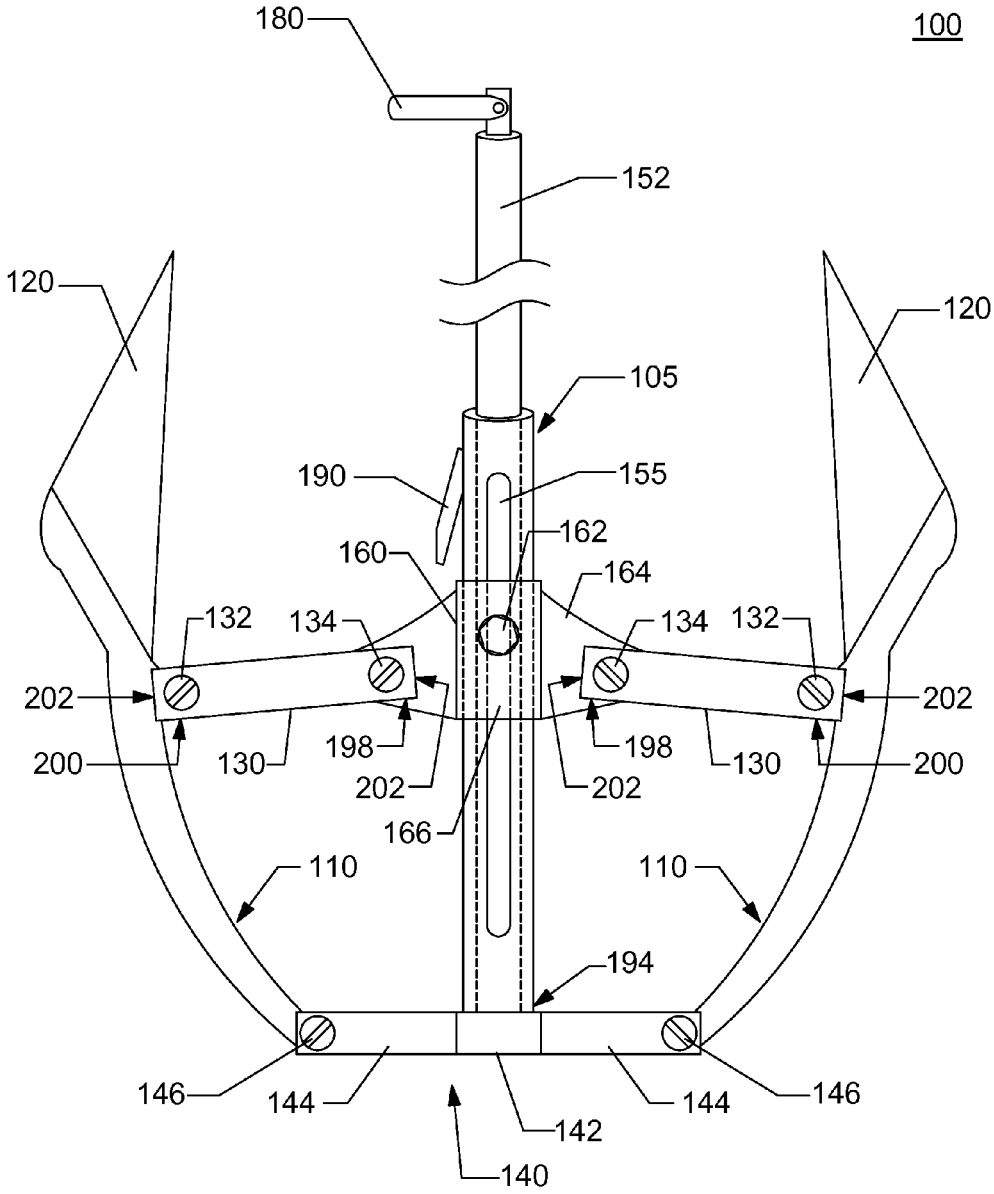
FIG. 2 illustrates a side view of a fold-up grappling device in an unfolded position in accordance with an exemplary embodiment of the present invention.

FIGS. 1 and 2 illustrate a side view of a fold-up grappling device 100 in a folded position and unfolded position, respectively, in accordance with some exemplary embodiments of the present invention. The fold-up grappling device 100 is configured to open and close the armatures (grappling arms 110) in a manner that is similar to an umbrella, as will be described in more detail later. When the foldable arms 110 are open or unfolded, the grappling device 100 is configured to function to embed spike members 120, or flukes at ends of the arms, into the waterway floor or seabed.

The grappling device 100 includes a shank or crown 105 to which a plurality of foldable grappling arms 110 are attached. A free end of each of the grappling arms 110 has coupled thereto a spike member 120 or flukes. The shank or crown 105 includes a hollow tubular shaft member 150, also shown in FIG. 4, and a slide bar 152 configured to be slidably received in the hollow tubing of the hollow tubular shaft member 150. The slide bar 152 is telescopic in relation to the hollow tubular shaft member 150.

A lower end of the hollow tubular shaft member 150 has a base or lower central hub 140 coupled thereto. The lower central hub 140 has a plurality of spokes 144 radiating therefrom. The plurality of spokes 144 are generally equally spaced about hub ring 142 of the lower central hub 140 wherein each arm of the plurality of foldable grappling arms 110 has one end pivotally coupled to a respective one spoke 144. A free end of each spoke 144 is configured to be pivotally coupled to a first end 196 (best seen in FIG. 3) of an arm 110 at pivot coupler 146. For example, the free end of the spoke 144 includes a forked end 204 to receive the first end of the grappling arm 110.

The central axis of the lower central hub 140 is aligned with the longitudinal axis of the hollow tubular shaft 150 and the slide bar 152.

The shank or crown 105 further comprises a slide channel 155 formed along a portion of the length of tubing of the hollow tubular shaft member 150. The shank or crown 105 further includes a slidable collar 160 concentrically coupled about the hollow tubular shaft member 150. The slidable collar 160 is coupled to one end (bottom end) of the slide bar 152 via fastener 162. The fastener 162 slides within the slide channel 155, thereby restricting the range of movement of slidable collar 160.

Figure 7:
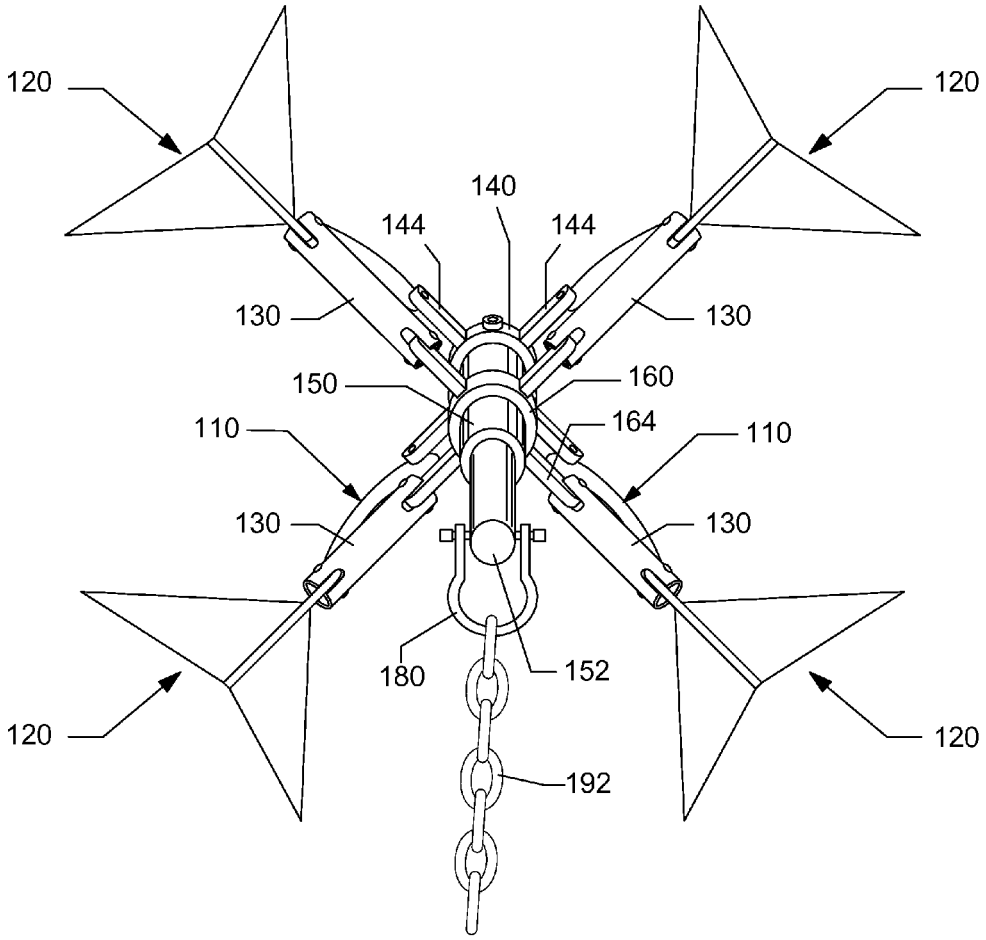
FIG. 7 illustrates a perspective top view of the fold-up grappling device in an unfolded position in accordance with an exemplary embodiment of the present invention.

The top end of the slide bar 152 has coupled thereto a ring or shackle 180 to attach the shank or crown 105 to a cable or chain 192 (see, e.g., FIG. 7).

The fold-up grappling device 100 further comprises a plurality of linking arms 130 configured to fold up and unfold the plurality of grappling arms 110 as the slidable collar 160 slides along the exterior of hollow tube shaft member 150 in conjunction with the movement of fastener 162 within channel 155. Each linking arm 130 has a first end 198 pivotally or hingedly coupled to the slidable collar 160 via first pivot coupler 134 and a second end 200 pivotally or hingedly coupled to a grappling arm 110 via second pivot coupler 132 at a distance above the first end 196 (see, e.g., FIG. 3) of the grappling arm 110.

The slidable collar 160 has a plurality of radiating tabs 164 to which the linking arm 130 is hingedly or pivotally attached via first pivot coupler 134. The radiating tabs 164 are generally equally spaced around the circumference of collar ring 166 of the slidable collar 160.

In an exemplary embodiment, the first and second ends of the linking arm 130 are forked ends 202 configured to create a hinge connection via the pivot couplers 134 or 132 between the slidable collar 160 and the grappling arm 110, respectively. The linking arm 130 is configured to push or pull one end of the grappling arm 110 away from or toward the shank or crown 105.

The grappling device 100 further includes a hook member 190 coupled to the exterior of the hollow tubular shaft member 150. The slide bar 152 may be tied, secured or fastened to a lower position, as best seen in FIG. 1, by hooking or tying a cable or chain 192 coupled to a ring or shackle 180 about the hook member 190. The ring or shackle 180 is coupled to a top end of telescopic slide bar 152. A chain link hooked to the hook member 190 of the device locks the device in a folded position. Disengaging the cable or chain 192 from the hook member 190 allows the slide bar 152 to slide upward (i.e., to telescope out of hollow tube shaft member 150). The lower position corresponds to a folded position of the grappling device 110.

The linking arms 130, collar 160 and central hub 140 with spokes 144 are made of a rigid synthetic material such as plastic, PVC, etc. However, other materials may be used. The shank or crown 105, arms 110 and spike members 120 are made of metal.

In operation, when the slide bar 152 is raised or pulled up from a lower position, the slidable collar 160 is simultaneously raised (i.e., slid toward a top end of the slide channel 155) causing the linking arms 130 to simultaneously, in unison, transition (pivot) from a substantially vertical position (FIG. 1) to substantially a horizontal position (FIG. 2). As the linking arms 130 move from the vertical position to the horizontal position, the grappling arms 110 are all simultaneously pushed away (pivoted) to an unfolded position (FIG. 2). As the grappling arms 110 are pushed away simultaneously to unfold, each grappling arm 110 pivots about hinge coupler 146 of a respective one spoke 144 in unison with the other grappling arms.

Figure 8:
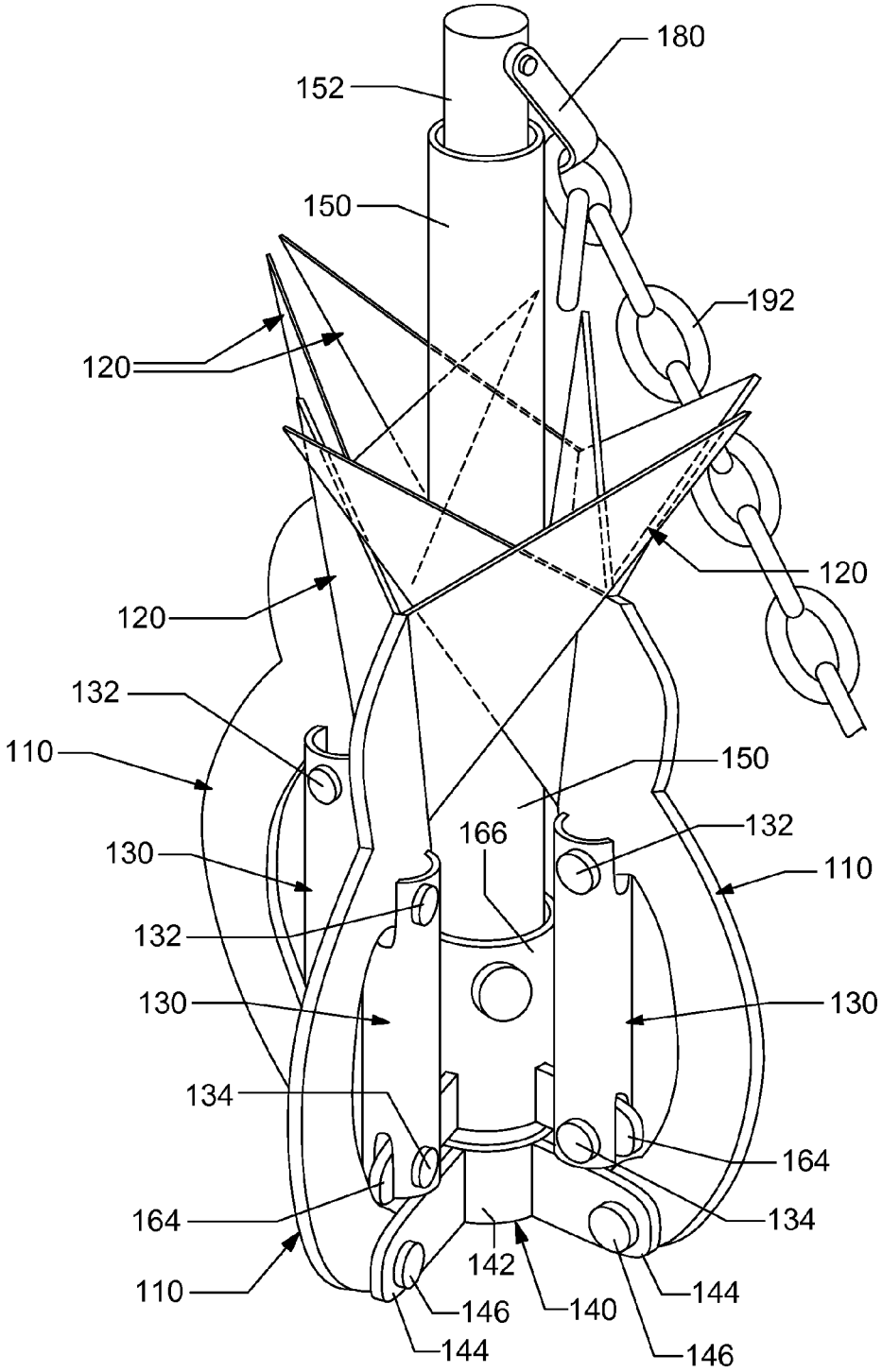
FIG. 8 illustrates a perspective view of the fold-up grappling device in a folded position in accordance with an exemplary embodiment of the present invention.

In operation, when the slide bar 152 is lowered or pushed down from a raised position, the slidable collar 160 is simultaneously lowered (slid in and toward a bottom of the slide channel 155) causing the linking arms 130 to simultaneously, in unison, transition (pivot) from a substantially horizontal position (FIG. 2) to substantially a vertical position (FIGS. 1 & 8). As the linking arms 130 move from the horizontal position to the vertical position, the grappling arms 110 are all simultaneously pulled in (pivoted) to a folded position (FIGS. 1 & 8). As the grappling arms 110 are pulled in simultaneously to fold, each grappling arm 110 pivots about hinge coupler 146 of a respective one spoke 144 in unison with the other grappling arms. In an exemplary embodiment shown in FIG. 8, the grappling arms 110 fold in such a way that the spike members 120 are tightly nested, thereby minimizing the size of the fold-up grappling device when said device is folded.

It should be noted that in the embodiment of FIG. 2, the slidable collar 160 has not reached the top of the slide channel 155. Therefore, to unfold, the linking arms 130 may pivot, from the vertical position, 90° or to a substantially horizontal position (see FIGS. 2, and 6). The linking arms 130 may travel a plurality of intermediate positions (1° to 89°) from the vertical position to the substantially horizontal position. Nonetheless, the linking arms 130 may travel more than 90° or less than 90° when being unfolded.

In an exemplary embodiment, if a pulling force applied to the slide bar 152 is released, the device will fold under gravity. However, from an unfolded position or any intermediate unfolded positions, in order to fully fold the arms, a force may be applied to the top of the slide bar 152 to push the slide bar 152 down until a fully folded position is achieved.

After the grappling device 100 is in a folded position, the cable or chain 192 (FIG. 1) may be fastened, hooked or tied via the hook member 190, thus allowing device 100 to be carried via a chain or rope 192, attached to ring 180, without inadvertently unfolding.

As can be appreciated, the grappling device 100 can be deployed in a number of ways. Thus, one example of deployment will be described in detail below.

When the grappling device 100 is deployed, the slide bar 152 should first be unhooked or otherwise disengaged from hook member 190 to an unlocked or unhooked state. When the grappling device 100 is lifted by a chain or cable attached to shackle 180, the slide bar 152 slides up along the hollow tubular shaft member 150 which can unfold the grappling arms 110, as previously described. Also, when the grappling device 100 is unlocked or unhooked, the weight of the grappling device 100 would unfold, or keep unfolded, the grappling arms 110 via gravity. Using the chain or cable, the grappling device 100 in the unfolded position can be dropped, flung, tossed or thrown, for example, off the side of a boat to embed the spike members 120 or flukes into the seabed, waterway floor, grass, rocks, oyster beds, etc.

The illustrations of FIGS. 1 and 2 show two foldable arms 110. However, the grappling device 100 may have a greater or lesser number of grappling arms. For example, as shown below in FIGS. 6-7, the grappling device may include four grappling arms. Nonetheless, the grappling device may have one, two, three, four or more grappling arms.

In an example embodiment, the grappling device 100, when folded, can fit within a five gallon container or storage container (not shown). Thus, as the water and mud drips and/or dries, the container can capture the water and mud to prevent the boat from being soiled. Additionally, the storage container also hides, covers or encloses the spike members 120 from harm's way between uses of the grappling device 100. The grappling device 100 can be easily cleaned in the storage container.

Figure 3:
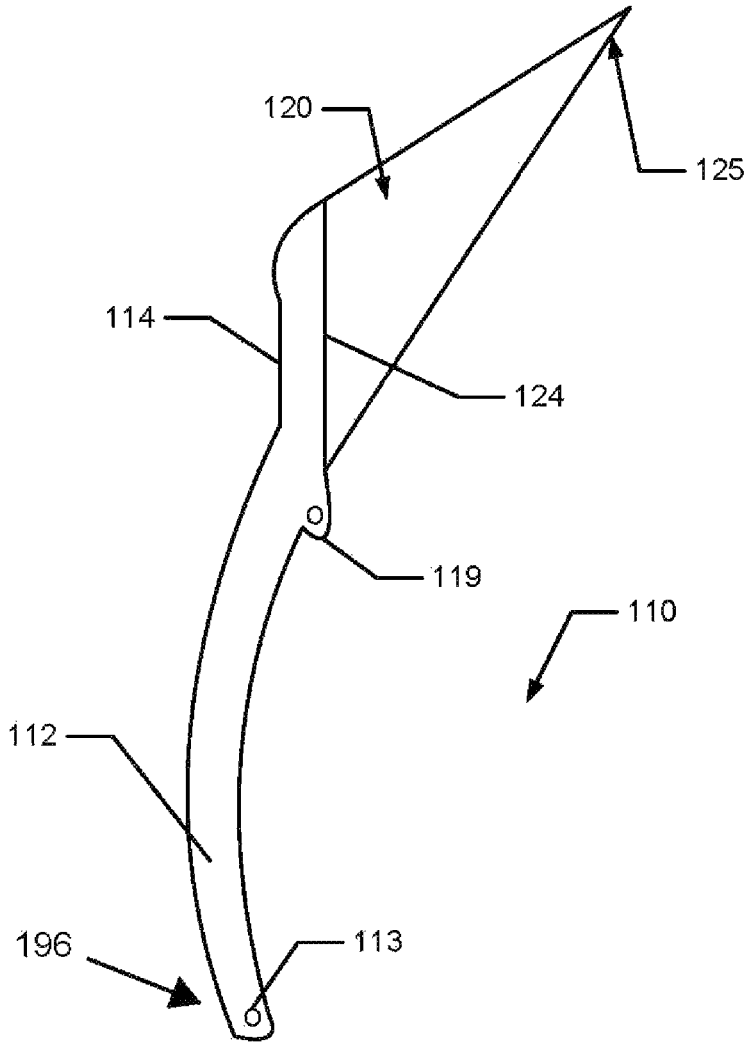
FIG. 3 illustrates a side view of a foldable grappling arm in accordance with an exemplary embodiment of the present invention.

FIG. 3 illustrates a side view of a foldable grappling arm 110 in accordance with some exemplary embodiments of the present invention. Each grappling arm 110 includes an arch shaped lower arm section 112 and a top arm section 114 constructed as a single unitary part. One end of the arch shaped lower arm section 112 has a first end 196 which includes a hole 113 formed therein to couple to pivot coupler 146 within the forked end of the spoke 144. The other end of the arch shaped lower arm section 112 includes a tab 119 with second hole, providing a hinge connection to the linking arm 130 via the hinge coupler 132. In the exemplary embodiment, each grappling arm is curved or convexed.

While the exemplary embodiment places the forked end (i.e., forked end 533 of FIG. 5) of a hinge connection on the spoke 144 or linking arm 130, in an alternate embodiment, the forked end may be placed on the end of the lower arm section 112.

The top arm section 114 is generally linear and has a straight edge 124 having coupled thereto the spike members 120 or fluke. One side of the spike members 120 is illustrated as having a generally triangularly shaped profile. A point 125 of the spike members 120 or fluke serves as a spike or grip to pierce the seabed, floor, grass, etc.

Figure 4:
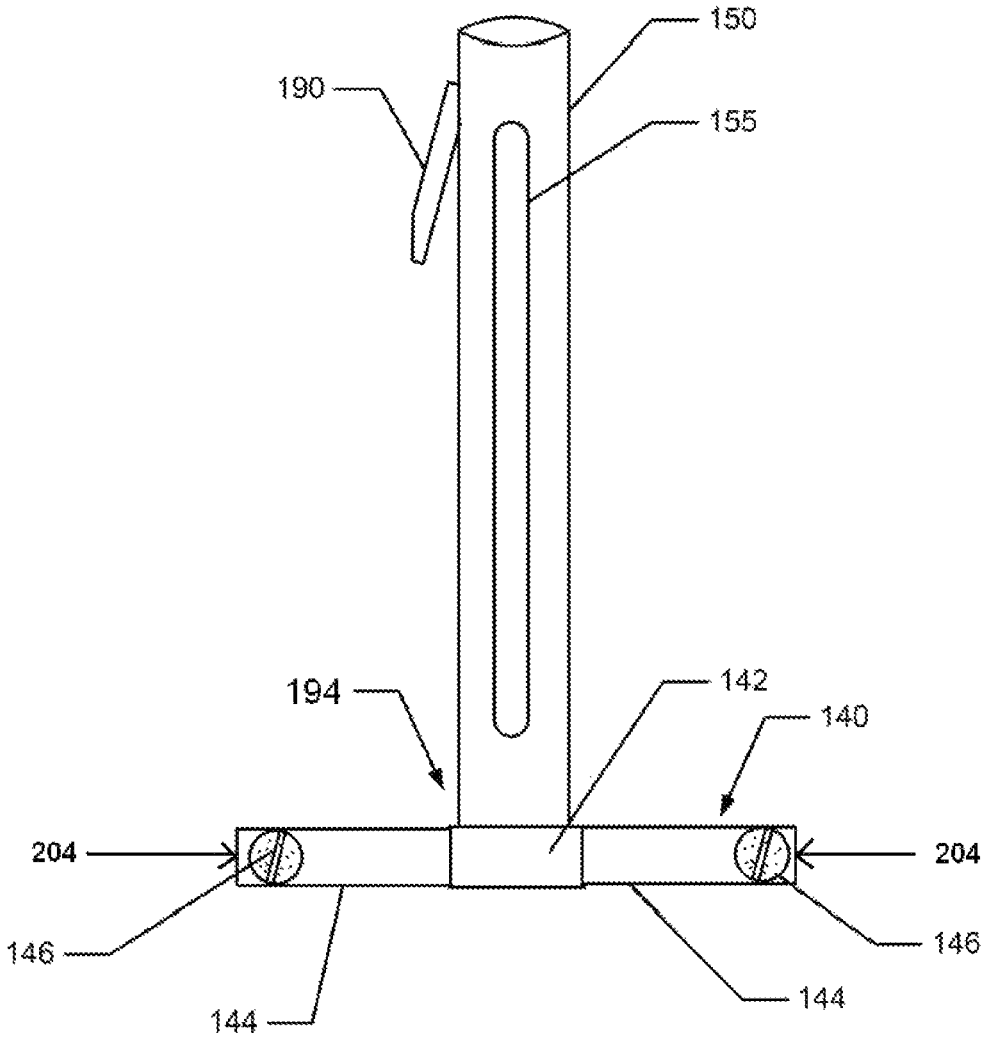
FIG. 4 illustrates a front view of the shank or crown in accordance with an exemplary embodiment of the present invention.

FIG. 4 illustrates lower central hub 140 and hub ring 142 coupled to the hollow tubular shaft member 150 at its lower end 194.

Figure 5:
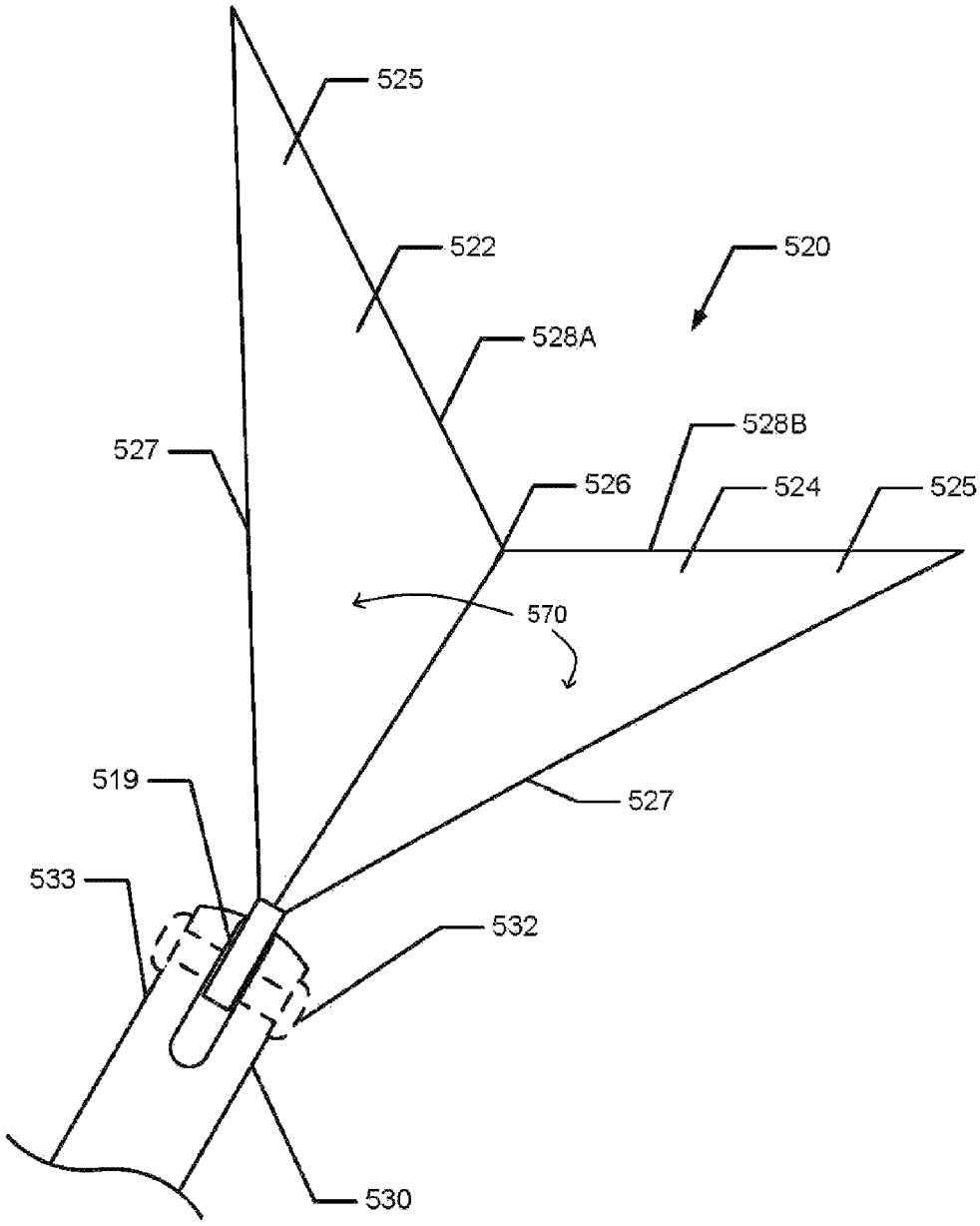
FIG. 5 illustrates a view of a double spike member in accordance with an exemplary embodiment of the present invention.

FIG. 5 illustrates a view of a double spike member 520 in accordance with some exemplary embodiments of the present invention. The spike member 520 of the present invention includes a first triangularly shaped spike member 522 and a second triangularly shaped spike member 524 angularly coupled with respect to the other about a common edge 526. The double spike member 520 resembles a pair of wings or an arrow head. Top edges 528A and 528B between the first triangularly shaped spike member 522 and the second triangularly shaped spike member 524 create a V profile. Likewise, the angled orientation between the planar surfaces of the first triangularly shaped spike member 522 and the second triangularly shaped spike member 524 creates a V shaped flat surface 570.

The first triangularly shaped spike member 522 and the second triangularly shaped spike member 524 are generally flat plates. The points 525 of the first triangularly shaped spike member 522 and the second triangularly shaped spike member 524 are configured to embed or grip the seabed, waterway floor, grass, etc.

The base of the double spike member 520 is integrated to the grappling arm. Below the base, the linking arm 530 is attached via a hinge coupler 532. The linking arm 530 has a forked end 533. The grappling arm includes tab 519 with a hole to connect the hinge coupler 532. The combination of the forked end 533, tab 519 and hinge coupler 532 encompasses a hinge connection. Other hinge connections described herein have a similar configuration. However, other hinge or pivoting connections may be used.

Each of the first triangularly shaped spike member 522 and the second triangularly shaped spike member 524 includes an inner edge 527 wherein a top point of the inner edge 527 corresponds to point 525. In an exemplary embodiment, when the chain or cable is pulled in a direction to unfold the arms and the arms unfold, the inner edge 527 of the spike member 520 is moved such that the inner edge 527 may be parallel or near parallel to the chain or cable (or the hollow tubular shaft member 150), as can be seen in relation to FIGS. 6 and 7.

Figure 6:
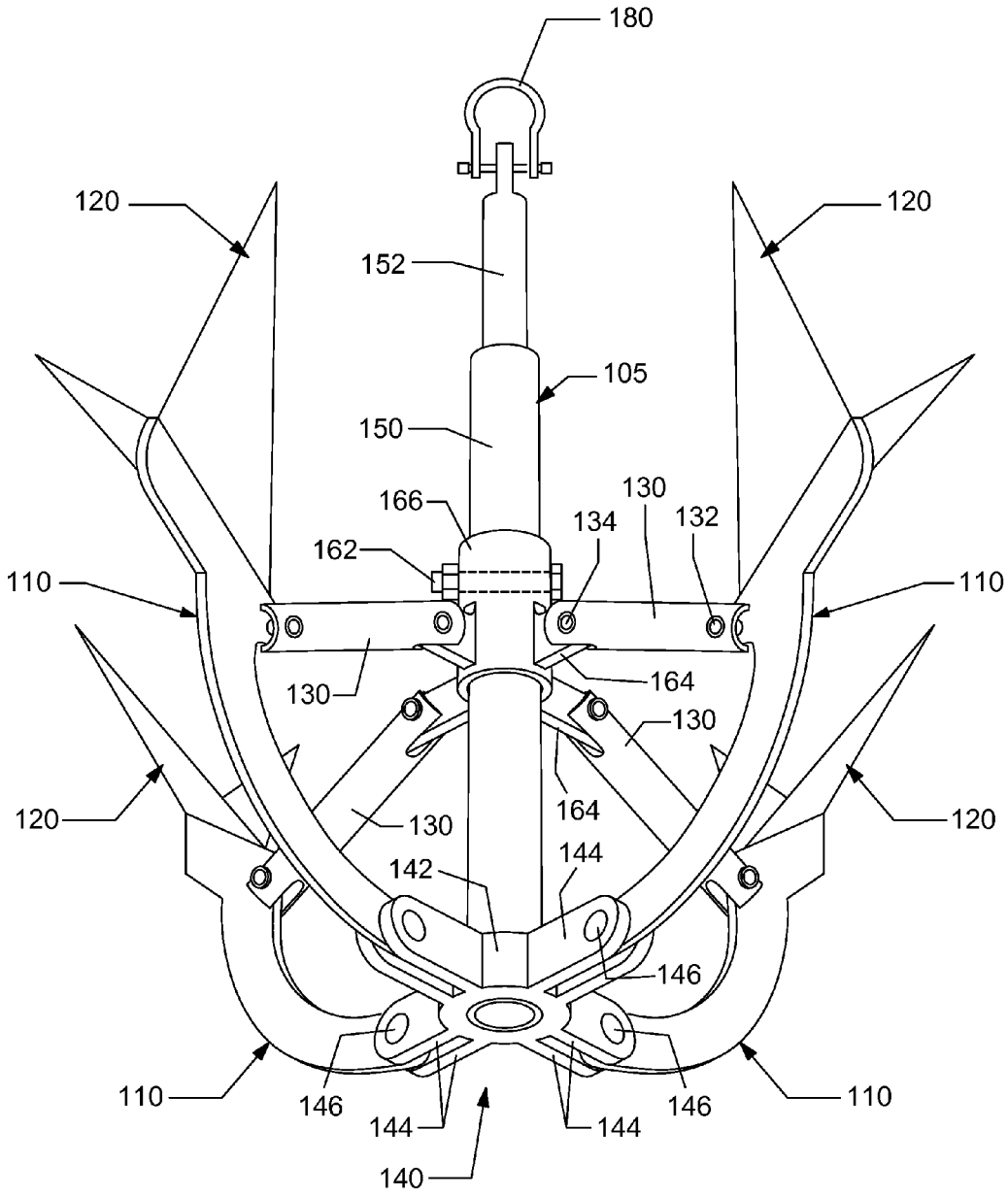
FIG. 6 illustrates a perspective view of the fold-up grappling device in an unfolded position in accordance with an exemplary embodiment of the present invention.

FIG. 6 illustrates a perspective bottom view of the fold-up grappling device in an unfolded position in accordance with some exemplary embodiments of the present invention. As can be seen, there are four grappling arms.

FIG. 7 illustrates a perspective top view of the fold-up grappling device in an unfolded position in accordance with some exemplary embodiments of the present invention.

FIG. 8 illustrates a perspective view of an exemplary embodiment of the fold-up grappling device in a folded position, wherein the foldable arms 110 of said device close in unison such that the respective spike members 120 of each respective foldable arm 110 are closely nested around, and snuggly seated against, crown 105, thereby minimizing the relative size of the fold-up grappling device. Further, in this embodiment some of the spike members 120 associated with a given foldable arm 110, when in a folded configuration, may be oriented closer to crown 105 than the spike members 120 associated with other foldable arms 110, thus creating an overlapping, or nested, configuration of said spike members 120.

In view of the foregoing, the grappling device of the present invention can be used as an anchor for a boat or other vessel.

In view of the above, the grappling device may be used as a grapnel anchor.

In view of the above, the grappling device includes spikes or claws that enhance the gripping force generated as the spike members embed themselves in the ground, mud, seabed, ice, sand, grass, etc., as the telescopic slide bar is pulled.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

That which is claimed is:

1. A fold-up grappling device comprising:

a shank or crown having a hollow tubular shaft member and a telescopic slide bar slidably coupled within said hollow tubular shaft member;

a plurality of foldable grappling arms attached to a base of said shank or crown; and a plurality of linking arms coupled to said telescopic slide bar to push said grappling arms to an unfolded position from a folded position or to pull said grappling arms to said folded position from said unfolded position, wherein raising said telescopic slide bar within said hollow tubular shaft member unfolds said foldable grappling arms simultaneously, and lowering said telescopic slide bar folds said foldable grappling arms simultaneously;

wherein said shank or crown further comprises a slidable collar which is coupled to said plurality of linking arms and to said telescopic slide bar, and which is further concentrically coupled about said hollow tubular shaft member; wherein said slidable collar is positioned at a lower end of said hollow tubular shaft member when said grappling arms are in said folded position.

2. The fold-up grappling device according to claim 1, wherein said shank or crown further comprises a fastener and a slide channel wherein said fastener couples said slidable collar to said telescopic slide bar and slides within said slide channel thereby restricting a range of movement of said slidable collar.

3. The fold-up grappling device according to claim 2, wherein said plurality of linking arms is configured to fold up and unfold said plurality of foldable grappling arms as said slidable collar slides along an exterior of said hollow tube shaft member in conjunction with movement of said fastener within said slide channel.

4. The fold-up grappling device according to claim 1, wherein each of said plurality of foldable grappling arms further comprises a spike member or fluke.

5. The fold-up grappling device according to claim 4, wherein said plurality of foldable grappling arms are capable of folding simultaneously.

6. The fold-up grappling device according to claim 1, wherein said shank or crown further comprises a central hub which comprises a hub ring having a plurality of spokes radiating therefrom, wherein each of said plurality of spokes includes a forked end configured to receive one of said plurality of foldable grappling arms in a pivotal coupling.

7. The fold-up grappling device according to claim 1, wherein each of said plurality of linking arms has a first end pivotally coupled to said slidable collar via a first pivot coupler, and each of said plurality of linking arms has a second end pivotally coupled to one of said plurality of foldable grappling arms via a second pivot coupler at a distance above a first end of one of said plurality of foldable grappling arms.

8. The fold-up grappling device according to claim 7, wherein said first and second ends of each of said plurality of linking arms further comprise forked ends configured to create a hinge connection, via said first and second pivot couplers, between said slidable collar or each of said plurality of foldable grappling arms, respectively.

9. The fold-up grappling device according to claim 7, wherein said slidable collar further comprises a plurality of radiating tabs configured such that one of said plurality of linking arms is pivotally attached to one of said plurality of radiating tabs via said first pivot coupler.

10. The fold-up grappling device according to claim 9, wherein said slidable collar further comprises a collar ring whereby said plurality of radiating tabs are generally equally spaced around a circumference of said collar ring.

11. The fold-up grappling device according to claim 1, wherein said fold-up grappling device will assume said folded position when no pulling force is applied to said telescopic slide bar.

12. The fold-up grappling device according to claim 1, wherein said fold-up grappling device comprises a range of 2 to 4 foldable grappling arms.

13. The fold-up grappling device according to claim 1, wherein each of said plurality of foldable grappling arms is curved.

14. The fold-up grappling device according to claim 1, wherein each of said plurality of foldable grappling arms further comprises a spike member and said spike member comprises a point, wherein said point of said spike member serves to grip a surface when said fold-up grappling device is deployed.

15. A fold-up grappling device comprising:

a shank or crown having a hollow tubular shaft member and a telescopic slide bar slidably coupled within said hollow tubular shaft member;

a plurality of foldable grappling arms attached to a base of said shank or crown; and a plurality of linking arms coupled to said telescopic slide bar to push said grappling arms to an unfolded position from a folded position or to pull said grappling arms to said folded position from said unfolded position, wherein raising said telescopic slide bar within said hollow tubular shaft member unfolds said foldable grappling arms simultaneously, and lowering said telescopic slide bar folds said foldable grappling arms simultaneously;

wherein each of said plurality of foldable grappling arms further comprises a spike member or fluke; and wherein a spike member or fluke of a first foldable grappling arm of said plurality of foldable grappling arms is located closer to said shank or crown than a spike member or fluke of a second foldable grappling arm of said plurality of foldable grappling arms when said grappling arms are in a folded position.

16. The fold-up grappling device according to claim 15, wherein said spike member or fluke of said first foldable grappling arm is closer to said crown than a spike member or fluke of any of said plurality of foldable grappling arms located adjacent to said first foldable grappling arm.

17. A fold-up grappling device comprising:

a shank or crown having a hollow tubular shaft member and a telescopic slide bar slidably coupled within said hollow tubular shaft member;

a plurality of foldable grappling arms attached to a base of said shank or crown; and a plurality of linking arms coupled to said telescopic slide bar to push said grappling arms to an unfolded position from a folded position or to pull said grappling arms to said folded position from said unfolded position, wherein raising said telescopic slide bar within said hollow tubular shaft member unfolds said foldable grappling arms simultaneously, and lowering said telescopic slide bar folds said foldable grappling arms simultaneously;

wherein each of said plurality of foldable grappling arms further comprises a spike member or fluke; wherein said plurality of foldable grappling arms are capable of folding simultaneously; and, wherein each said spike member or fluke of said plurality of foldable grappling arms are arranged in an overlapping nested arrangement when said grappling arms are in a folded position.

18. A fold-up grappling device comprising:

a shank or crown having a hollow tubular shaft member and a telescopic slide bar slidably coupled within said hollow tubular shaft member;

a plurality of foldable grappling arms attached to a base of said shank or crown; and a plurality of linking arms coupled to said telescopic slide bar to push said grappling arms to an unfolded position from a folded position or to pull said grappling arms to said folded position from said unfolded position, wherein raising said telescopic slide bar within said hollow tubular shaft member unfolds said foldable grappling arms simultaneously, and lowering said telescopic slide bar folds said foldable grappling arms simultaneously; and a hook member coupled to an exterior of said hollow shaft member and a shackle coupled to a top end of said telescopic slide bar, wherein said telescopic slide bar can be secured in a lower position by coupling a chain to said shackle and fastening said chain to said hook member.

19. A fold-up grappling device comprising:

a shank or crown having a hollow tubular shaft member and a telescopic slide bar slidably coupled within said hollow tubular shaft member;

a plurality of foldable grappling arms attached to a base of said shank or crown; and a plurality of linking arms coupled to said telescopic slide bar to push said grappling arms to an unfolded position from a folded position or to pull said grappling arms to said folded position from said unfolded position, wherein raising said telescopic slide bar within said hollow tubular shaft member unfolds said foldable grappling arms simultaneously, and lowering said telescopic slide bar folds said foldable grappling arms simultaneously;

wherein each of said plurality of folding grappling arms further comprises a double spike member which double spike member includes a first triangularly shaped spike member and a second triangularly shaped spike member angularly coupled with respect to said first triangularly shaped spike member about a common edge.

20. The fold-up grappling device according to claim 19, wherein said double spike member further comprises top edges between said first triangularly shaped spike member and said second triangularly shaped spike member wherein said top edges create a V profile.

21. The fold-up grappling device according to claim 19, wherein said double spike member further comprises an angled orientation between planar surfaces of said first triangularly shaped spike member and said second triangularly shaped spike member creating a V shaped flat surface.

22. A foldable grappling device comprising:

a shank or crown comprising: (i) a hollow tubular shaft member coupled to a central hub at a lower end of said hollow tubular shaft member; (ii) a telescopic slide bar configured to be slidably received in said hollow tubular shaft member; and (iii) a slidable collar concentrically coupled about said hollow tubular shaft member and having a fastener which slides within a slide channel formed along a portion of a length of said hollow tubular shaft member;

a plurality of foldable grappling arms pivotally attached to said shank or crown; and a plurality of linking arms, where each respective linking arm is coupled to said slidable collar and to one of said plurality of foldable grappling arms.

23. The foldable grappling device according to claim 22, wherein said slidable collar is positioned at a lower end of said hollow tubular shaft member when said grappling arms are in a folded position.

24. The foldable grappling device according to claim 22, wherein said fastener slides within said slide channel thereby restricting a range of movement of said slidable collar.

25. The foldable grappling device according to claim 22, wherein each of said plurality of foldable grappling arms comprises a spike member or fluke.

26. The fold-up grappling device according to claim 25, wherein a spike member or fluke of a first foldable grappling arm of said plurality of foldable grappling arms is located closer to said shank or crown than a spike member or fluke of a second foldable grappling arm of said plurality of foldable grappling arms when said grappling arms are in a folded position.

27. The fold-up grappling device according to claim 26, wherein said spike member or fluke of said first foldable grappling arm is closer to said crown than a spike member or fluke of any of said plurality of foldable grappling arms located adjacent to said first foldable grappling arm.

28. The fold-up grappling device according to claim 25, wherein said plurality of foldable grappling arms are capable of folding simultaneously.

29. The fold-up grappling device according to claim 28, wherein each said spike member or fluke of said plurality of foldable grappling arms are arranged in an overlapping nested arrangement when said grappling arms are in a folded position.

30. The foldable grappling device according to claim 22, wherein said shank or crown further comprises a central hub which comprises a hub ring having a plurality of spokes radiating therefrom, wherein each of said plurality of spokes includes a forked end configured to receive one of said plurality of foldable grappling arms in a pivotal coupling.

31. The foldable grappling device according to claim 22, wherein said shank or crown further comprises a ring or shackle coupled to a top end of said telescopic slide bar.

32. The fold-up grappling device according to claim 31, wherein said ring or shackle is arranged to attach a cable or chain thereto.

33. The foldable grappling device according to claim 22, wherein said plurality of linking arms are configured to fold up and unfold said plurality of foldable grappling arms as said slidable collar slides along an exterior of said hollow tube shaft member in conjunction with movement of said fastener within said slide channel.

34. The foldable grappling device according to claim 33, wherein each of said plurality of linking arms has a first end pivotally coupled to said slidable collar via a first pivot coupler, and each of said plurality of linking arms has a second end pivotally coupled to one of said plurality of foldable grappling arms via a second pivot coupler at a distance above a first end of one of said plurality of foldable grappling arms.

35. The foldable grappling device according to claim 34, wherein said first and second ends of each of said plurality of linking arms further comprise forked ends configured to create a hinge connection, via said first and second pivot couplers, between said slidable collar or each of said plurality of foldable grappling arms, respectively.

36. The foldable grappling device according to claim 33, wherein said plurality of linking arms are configured to push or pull said plurality of foldable grappling arms away from or toward said shank or crown.

37. The foldable grappling device according to claim 22, wherein said slidable collar comprises a plurality of radiating tabs configured such that one of said plurality of linking arms is pivotally attached to one of said plurality of radiating tabs via said first pivot coupler.

38. The foldable grappling device according to claim 37, wherein said slidable collar further comprises a collar ring whereby said plurality of radiating tabs are generally equally spaced around a circumference of said collar ring.

39. The foldable grappling device according to claim 22, further comprising a hook member coupled to an exterior of said hollow shaft member and a shackle coupled to a top end of said telescopic slide bar, whereby said telescopic slide bar can be secured in a lower position by coupling a chain to said shackle and fastening said chain to said hook member.

40. The foldable grappling device according to claim 22, wherein said fold-up grappling device will assume a folded position when no pulling force is applied to said telescopic slide bar.

41. The foldable grappling device according to claim 22, wherein said foldable grappling device comprises a range of 2 to 4 foldable grappling arms.

42. The foldable grappling device according to claim 22, wherein each of said plurality of foldable grappling arms is curved.

43. The foldable grappling device according to claim 22, wherein each of said plurality of foldable grappling arms further comprises a spike member and said spike member comprises a point, wherein said point of said spike member serves to grip a surface when said foldable grappling device is deployed.

44. The foldable grappling device according to claim 22, wherein each of said plurality of foldable grappling arms further comprises a double spike member which double spike member includes a first triangularly shaped spike member and a second triangularly shaped spike member angularly coupled with respect to said first triangularly shaped spike member about a common edge.

45. The foldable grappling device according to claim 44, wherein said double spike member further comprises top edges between said first triangularly shaped spike member and said second triangularly shaped spike member wherein said top edges create a V profile.

46. The foldable grappling device according to claim 44, wherein said double spike member further comprises an angled orientation between planar surfaces of said first triangularly shaped spike member and said second triangularly shaped spike member creating a V shaped flat surface.

47. A grappling device, comprising:

a shank or crown having a receiving means for receiving a telescopic slide bar, which telescopic slide bar is slidably coupled to said receiving means;

a means for grappling, where said grappling means is attached to a base of said shank or crown; and a means for pushing said grappling means to an unfolded position from a folded position and for pulling said grappling means to said folded position from said unfolded position; wherein said pushing and pulling means is coupled to said telescopic slide bar;

wherein said shank or crown further comprises a slidable collar which is coupled to said pushing and pulling means and coupled to said receiving means, wherein said slidable collar is positioned at a lower end of said receiving means when said grappling means is folded.

48. The grappling device according to claim 47, wherein said shank or crown further comprises a fastening means for coupling said slidable collar to said telescopic slide bar and wherein said fastening means slides within a slide channel of said shank or crown thereby restricting a range of movement of said slidable collar.

49. The grappling device according to claim 48, wherein said fastening means comprises a bolt.

50. The grappling device according to claim 48, wherein said pushing and pulling means is configured to fold up and unfold said grappling means as said slidable collar slides along said receiving means in conjunction with movement of said fastening means within said slide channel.

51. The grappling device according to claim 47, wherein said grappling means further comprises an embedding means for embedding said grappling means in a surface.

52. The grappling device according to claim 51, wherein said embedding means comprises a spike member or fluke.

53. The grappling device according to claim 47, wherein said shank or crown further comprises a central hub which comprises a hub ring having a plurality of spokes radiating therefrom, and wherein each of said plurality of spokes includes a pivotal coupling means configured to receive one of said plurality of grappling means.

54. The grappling device according to claim 53, wherein said pivotal coupling means comprises a forked end.

55. The grappling device according to claim 47, wherein said receiving means comprises a hollow tubular shaft member.

56. The grappling device according to claim 47, wherein said pushing and pulling means comprises a plurality of linking arms.

57. A grappling device, comprising:

a shank or crown having a receiving means for receiving a telescopic slide bar, which telescopic slide bar is slidably coupled to said receiving means;

a means for grappling, where said grappling means is attached to a base of said shank or crown; and a means for pushing said grappling means to an unfolded position from a folded position and for pulling said grappling means to said folded position from said unfolded position; wherein said pushing and pulling means is coupled to said telescopic slide bar;

wherein said grappling means further comprises an embedding means for embedding said grappling means in a surface, and wherein said embedding means is arranged in an overlapping nested arrangement when said grappling means is in said folded position.

58. A grappling device, comprising:

a shank or crown having a receiving means for receiving a telescopic slide bar, which telescopic slide bar is slidably coupled to said receiving means;

a means for grappling, where said grappling means is attached to a base of said shank or crown; and a means for pushing said grappling means to an unfolded position from a folded position and for pulling said grappling means to said folded position from said unfolded position; wherein said pushing and pulling means is coupled to said telescopic slide bar;

wherein said grappling means further comprises an embedding means for embedding said grappling means in a surface, and wherein said embedding means further comprises a plurality of spike members or flukes, wherein a first spike member or fluke of said plurality of spike members or flukes is located closer to said shank or crown than a second spike member or fluke of said plurality of spike members or flukes when said grappling means is in said folded position.

59. The fold-up grappling device according to claim 58, wherein said first spike member or fluke is closer to said shank or crown than any spike member or fluke of said plurality of spike members or flukes that is located adjacent to said first spike member or fluke.

* * * * *